United States Patent [19]

Tayebi

[11] 4,449,353

[45] May 22, 1984

[54] GUT STRING FOR SPORTS RACKETS

[75] Inventor: Amad Tayebi, Westford, Mass.

[73] Assignee: United States Tennis Gut Association, Inc., Emerson, N.J.

[21] Appl. No.: 405,913

[22] Filed: Aug. 6, 1982

[51] Int. Cl.[3] ..... D02G 3/10; D02G 3/40; D02G 3/44

[52] U.S. Cl. ..... 57/242; 57/211; 57/234; 57/236; 57/7; 57/282; 57/292; 273/73 R

[58] Field of Search ..... 57/210, 211, 231, 232, 57/233, 234, 235, 236, 241, 242, 243, 244, 250, 251, 258, 259, 3, 6, 7, 13, 31, 32, 282, 295, 292, 297, 310; 273/73 R, DIG. 23

[56] References Cited

U.S. PATENT DOCUMENTS

| | | | |
|---|---|---|---|
| 31,049 | 1/1861 | Wortendyke . | |
| 1,497,068 | 6/1924 | Collingbourne . | |
| 1,624,720 | 4/1927 | Dritz | 273/73 |
| 1,689,119 | 10/1928 | Evans . | |
| 1,970,376 | 8/1934 | Hamburger | 117/53 |
| 2,134,022 | 10/1938 | Bell . | |
| 2,307,470 | 1/1943 | Salathe | 117/141 |
| 2,319,312 | 5/1943 | Finlayson . | |
| 2,343,892 | 3/1944 | Dodge et al. . | |
| 2,401,291 | 5/1946 | Smith . | |
| 2,735,258 | 2/1956 | Crandall | 57/234 |
| 2,821,835 | 2/1958 | Berry . | |
| 2,861,417 | 11/1958 | Crandall | 57/310 X |
| 2,917,891 | 12/1959 | Murdock . | |
| 3,050,431 | 8/1962 | Crandall | 57/7 |
| 3,298,856 | 1/1967 | Harding | 428/473 |
| 3,419,059 | 12/1968 | Bridge . | |
| 3,652,510 | 3/1972 | Blomberg . | |
| 3,673,143 | 6/1972 | Bair et al. . | |
| 3,699,085 | 10/1972 | Johnson . | |
| 3,738,096 | 6/1973 | Crandall | 57/242 |
| 3,745,756 | 7/1973 | Crandall | 57/234 |
| 3,920,658 | 11/1975 | Benson | 273/73 R X |
| 4,016,714 | 4/1977 | Crandall et al. | 57/234 |
| 4,055,941 | 11/1977 | Rivers, Jr. et al. . | |
| 4,084,399 | 4/1978 | Kanemaru et al. | 57/251 X |
| 4,155,394 | 5/1979 | Shepherd et al. . | |
| 4,183,200 | 1/1980 | Bajaj | 57/234 |
| 4,202,164 | 5/1980 | Simpson et al. | 57/232 |
| 4,275,117 | 6/1981 | Crandall | 57/251 X |
| 4,377,620 | 3/1983 | Alexander | 273/73 R X |
| 4,391,088 | 7/1983 | Salsky et al. | 273/73 R X |

OTHER PUBLICATIONS

Structural Mechanics of Fibers, Yarns, and Fabrics, Copyright 1969, by John Wiley & Sons, Inc.

*Primary Examiner*—Donald Watkins
*Attorney, Agent, or Firm*—Charlotte M. Kraebel

[57] ABSTRACT

A natural gut string for sports rackets comprises at least two gut strands, each strand of which comprises a plurality of gut ribbons twisted together in a first direction, which strands are combined and re-twisted together in a direction opposite to the first direction. In a process for making the gut strings, the gut ribbons and gut strands are preferably twisted under tension.

53 Claims, 14 Drawing Figures

Fig. 1
PRIOR ART
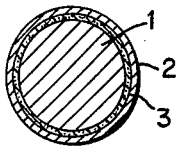
Fig. 2 PRIOR ART
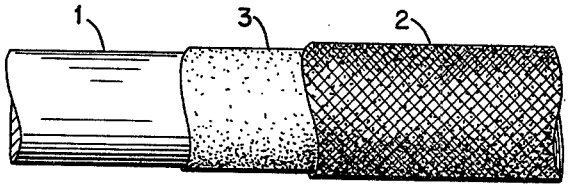
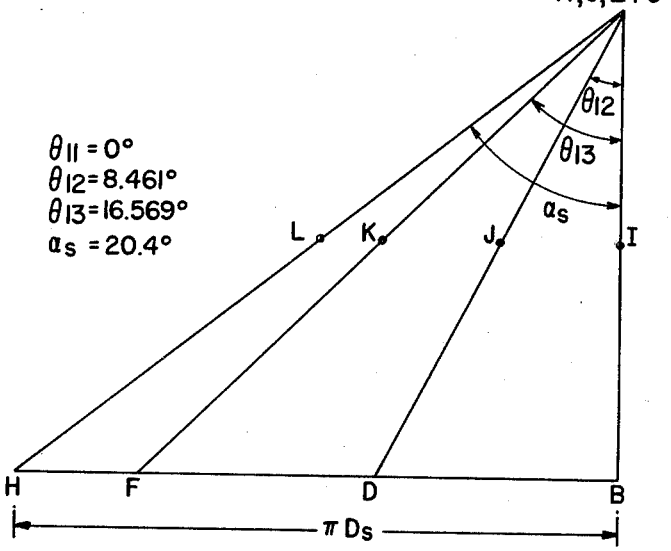
Fig. 4
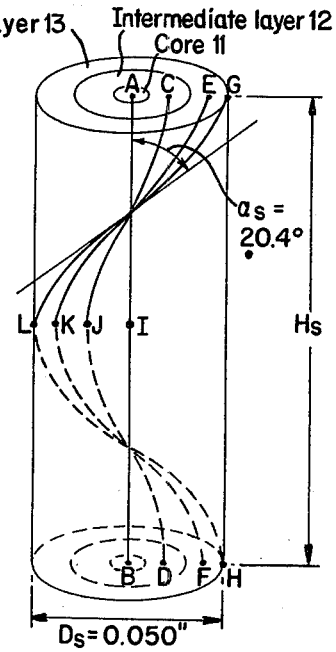
Fig. 3
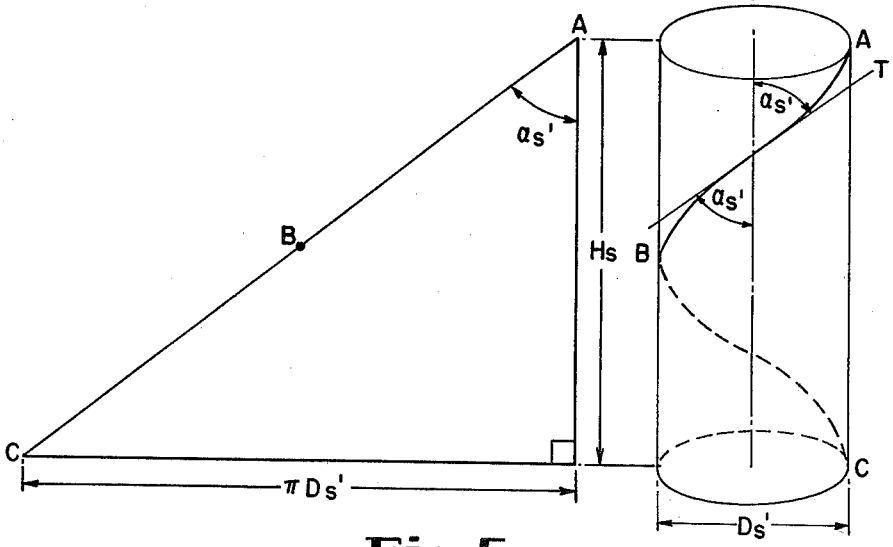
Fig. 5

GUT STRING FOR SPORTS RACKETS

DESCRIPTION

1. Technical Field

This invention relates to improved natural gut string constructions for rackets, particularly to strings capable of being stretched in the frame of a racket appropriate for sports such as tennis, badminton, squash, racket ball or the like.

2. Prior Art

In the field of tennis racket strings and the like, there are, generally speaking, two types of strings; natural gut strings and synthetic strings. Natural gut strings are made of continuous ribbons of the central layer—(the serosa layer)—of animal intestines. The serosa layer contains collagen. Collagen is a biological fibrous material which has high strength, natural resilience and contains its own natural adhesive which bonds the ribbons together into a twisted round cross-section string. Conventional animal gut string manufacturing is a discontinuous process in which a set of gut ribbons are twisted together to form the final product. The twist is essential for string abrasion resistance as well as maintaining the roundness of the string cross sectional shape. The twist is also essential for minimization of string flattening—at the cross over points and at the holes in the racket—and subsequent loss of string tension. Inherently, however, the twisted gut string breaking strength is, due to twist, lower than the sum of intrinsic strengths of all component gut ribbons.

Tensile strength and stringing tension requirements in natural gut strings have been met by twisting together a number of ribbons sufficient to meet such requirements. For example, in a typical tennis racket string, 16 gut ribbons, each $\frac{5}{8}''$ wide, are twisted together to form a string with a final diameter approximately 0.050 inch. Higher natural gut string strength can be obtained by increasing the number of ribbons. An undesirable feature, however, is that the string thickness is increased.

In the process of manufacture of conventional natural gut strings, ribbons of serosa layer of animal intestines are washed in baths of water, soap and enzymes then twisted, while in the wet state, to form a twisted string with a round cross-section. In a subsequent drying process, the string is hung between two points under a straightening load, typically 15–20 lbs.

A typical conventional tennis racket gut string twist level is in the range of 2.0 to 4.5 turns per inch. Expressed in another way, the surface helix angle ($\alpha_{s'}$), shown in FIG. 5, in such typical tennis racket gut string is usually in the range of approximately 17°–35° with a preferred range of 20°–31°.

In accepted procedures for processing animal gut string, the dried string is polished by treatment with a slightly abrasive material to produce a smooth, essentially cylindrical product, which is free of minute irregularities, knobs and undulations present in string at the end of the drying step.

Dritz has proposed, in U.S. Pat. No. 1,624,720, to wind wire helically around a stranded gut body, so as to embed the convolutions of the wire into the outer surface of the gut body and provide a string for rackets, which has the resiliency of natural gut, but has an outer wear surface provided by the wire. The gut string comprises a plurality of gut strands twisted together.

Salathe, Jr., has proposed in U.S. Pat. No. 2,307,470, to envelop a gut core with nylon to improve wear characteristics.

Synthetic strings feature various materials, material combinations and geometric arrangements. With regard to materials and material combinations, synthetic string varieties on the market include, nylon (solid monofilament, hollow monofilament filled with oil, multifilament and combinations thereof), graphite, graphite/nylon blends, nylon/aramid blends (with or without a protective coating and with or without fusion of filaments to form a unified structure) and steel wire/nylon blends. In terms of geometric arrangement, the synthetic strings on the market include, filaments twisted into singles or plied strands, twisted or untwisted multifilament core structures with filament overwraps (partial or complete), untwisted monofilament wrapped with a multifilament strand assembly or a nylon braid which is fused to the core and braided multifilaments.

Smith has proposed, in U.S. Pat. No. 2,401,291, a racket string formed from a cord of twisted nylon multifilament yarn, coated with nylon, to provide a tough, seamless skin over the twisted cord. The cord is made from nylon 6, 6, in the relaxed condition, by twisting a plurality of filaments in the S direction and combining several of the resulting strands and twisting in the Z direction. The string, after coating with an interpolyamide, is dried at an elevated temperature.

Benson has proposed, in U.S. Pat. No. 3,920,658, a tennis string of gut, nylon or polyester coated with skid-proof material and thus capable of imparting more spin to a tennis ball.

It has been proposed by Crandall (U.S. Pat. No. 3,050,431) to employ, in tennis strings, a multifilament core of thermoplastic material, surrounded by a braided or spirally wound thermoplastic sheath. The composite product is drawn through a heated die in a dry condition to integrate the string.

Crandall (U.S. Pat. No. 3,738,096) has proposed constructing an integrated string, with a gently undulated outer surface, from a plurality of individual thermoplastic strands, each individually twisted in a first direction, the strands then being twisted together in an opposite direction, and the resulting string being coated with a thermoplastic formulation. The composite structure is dried, stretched under heat and coated and dried again.

References disclosing cord, twine or reinforced structures containing a plurality of filaments or multifilament strands, twisted in various ways, include the following U.S. Pat. Nos.:

| | |
|---|---|
| 31,049 | Wortendyke |
| 1,497,068 | Collingbourne |
| 1,689,119 | Evans |
| 1,970,376 | Hamburger |
| 2,134,022 | Bell |
| 2,319,312 | Finlayson |
| 2,343,892 | Dodge et al. |
| 2,821,835 | Berry |
| 2,917,891 | Murdock |
| 3,419,059 | Bridge, Jr. |
| 4,155,394 | Shepherd et al. |

Although tennis racket strings made from animal gut have greater sensitivity and better "feel" to the player than strings made from plastics, natural gut tends to deteriorate rather rapidly. String made from animal gut is susceptible to the effects of moisture. Moist strings tend to stretch and then to contract upon drying, which leads to loss of resiliency and early breakage. Breakage of animal gut fibers means that rackets strung therewith must be restrung prematurely.

In many cases, the short useful life of natural gut strings is economically unacceptable, so that equipment manufacturers have proposed a variety of longer-lived tennis string constructions using plastic or elastomeric components. Among other structures disclosed in the U.S. Patent literature are those of:

| | |
|---|---|
| 2,735,258 | Crandall |
| 2,861,417 | Crandall |
| 4,016,714 | Crandall et al. |
| 4,055,941 | Rivers, Jr. et al. |
| 4,084,399 | Kanemaru et al. |
| 4,183,200 | Bajaj |
| 4,202,164 | Simpson et al. |
| 4,275,117 | Crandall |

Notwithstanding the longer life of tennis strings made from synthetic resins, many devoted tennis players prefer the playing characteristics imparted to a racket by natural gut strings and will tolerate the expense and inconvenience associated with periodic replacement or restringing of rackets having natural gut strings.

It will be understood that gut of small diameter has much better playing qualities than gut of larger diameter, but markedly shorter life. Therefore, attempts to improve the life span of string for rackets using gut of increased diameter have met with mixed acceptance, owing to loss of resiliency and "feel" as the diameter of the gut is increased.

Until the introduction of so-called oversize rackets, natural gut strings could be strung in conventional rackets at a tension of 48–65 lb., in which range the natural gut did not break during stringing. However, in order to make oversize rackets with acceptable playing qualities, it has been found that the rackets must be strung at about 70–85 lb. tension. As a result of the high tension used while stringing oversize rackets, natural gut strings broke both during stringing and after an unduly short useful life. This problem is particularly severe in the case of attempted use of thin gut string for oversize rackets.

One approach to the solution of this problem, as disclosed in commonly-assigned application, Ser. No. 339,082, filed Jan. 13, 1982 now U.S. Pat. No. 4,391,088, provides a gut-derived construction, adapted for stringing, under high tensions, in rackets for tennis or other racket sports and provides strings which retain the excellent play characteristics of gut strings and which do not undergo undue breakage during stringing or use. Specifically, this application discloses a string for sports rackets consisting of a gut core covered with filamentary aramid and impregnated with at least one coating of water-resistant, vapor-impermeable, wear-resistant, flexible, smooth adhesive polymeric resin to adhere the filamentary aramid to the gut core.

However, there is a need to improve this composite string, which is relatively thick and, accordingly, has less resiliency than is optimum, to provide a gut for sports rackets which will have the play qualities and "feel" of natural gut, but will have higher intrinsic strength properties than available heretofore.

It is accordingly an object of this invention to provide a thin gut structure, having excellent play characteristics, and higher strength properties than previously available.

DESCRIPTION OF INVENTION

In one aspect, this invention relates to a gut string for sports rackets, which comprises at least two gut strands, each strand comprising a plurality of gut ribbons twisted together in a first direction, which strands are combined and retwisted in a direction opposite to the first direction.

This invention relates, in another aspect, to a process for making a gut string for sports rackets, which comprises the steps of:

(a) assembling strands of a plurality of wet parallel-laid natural gut ribbons and individually twisting the thus-assembled wet strands in a first direction, (b) assembling at least two strands assembled and twisted in step (a) and retwisting the thus-assembled wet strands in a direction opposite to the first direction to form a wet gut string and (c) drying the wet gut string made in step (b) under a tension at least 5 lb.

In other aspects, this invention relates to strings made by the foregoing process and to sports rackets strung with the gut strings of this invention.

Gut strings or cores used in the practice of this invention are made by processing animal intestines, obtained from slaughterhouses, in a manner well known in the art. Owing to generally ready availability of animal intestines from meat processors, beef or sheep gut will be preferred for use in the practice of this invention.

The gut ribbons employed in the practice of this invention are accordingly obtained by treating ribbons of the serosa layer of animal intestines by washing in successive baths containing water, soap and enzymes.

Although polished gut strings can be used as cores for the aramid-coated strings of this invention, it has been found that unpolished gut is preferred, not only for economic reasons, but also because the increased surface area of the gut is thought to permit better engagement between the gut ribbons making up the gut string and the aramid filaments. Unpolished gut is also known as rough gut.

"Strand" as used in the specification and claims, means a plurality of parallel-laid gut ribbons. Each gut strand will preferably contain 2–9 gut ribbons, most preferably 6–8 gut ribbons.

The wet parallel-laid gut ribbons in each strand are preferably of about the same length and are joined at each end thereof, prior to twisting in a first direction. In the industry, it is conventional to employ gut ribbons of the order of 19 or 36 feet in length and about $\frac{5}{8}$ inch in width. The twisting of the wet parallel-laid ribbons in each strand in the first direction is done by fixing one end of the assembly and rotating the other end for the desired number of turns. Depending on the number of gut ribbons in each strand, it is preferred to employ 0.25–8.0 turns per inch at this stage of the process, most preferably 1.5–4.0 turns per inch for a typical tennis racket string application.

Still wet strands are combined and retwisted in a direction opposite to that of the first direction. Depending on the number of strands in the string, it is preferred that the combined strands are retwisted at 0.25–4.0 turns per inch, most preferably at 0.5–2.0 turns per inch. Although a plurality of gut strands can be employed to produce the final gut string, the use of two or three strands is preferred. Most preferably, the string of this invention will have two strands, twisted and retwisted as above.

Twisting of the parallel-laid gut ribbons to form gut strands and retwisting of the gut strands to form the strings of this invention is preferably done with the gut in a taut condition, most preferably under a tension of at least 5 lb. The final structure is dried under a tension of at least 5 lb., preferably 15–30 lb., at ambient temperatures preferably from 15° to 30° C.

The application of tension during the first direction ribbons twisting step results in the generation of radial compressive forces between the gut ribbons. Such forces compact the ribbons together and, due to the smaller number of ribbons comprising each strand, more effectively squeeze out fluids and impurities. It has been observed that dried gut strings made in accordance with this invention are optically clearer than dried conventional twisted gut strings made from the same batch of serosa layer ribbons.

It will be understood that, because the twisting and retwisting operations are normally done at different locations in the manufacturing plant, tension on the gut can be relaxed during the transfer from one location to another, without adversely affecting the improved properties of the finished gut string. When 12–16 gut ribbons, in the form of two or three gut strands, comprise the final gut string, the latter will have an equivalent diameter of about 0.050 inch.

In conventional twisted strings made from natural gut ribbons, the amount of twist is selected to maintain the roundness of the string and to improve its abrasion resistance. An inevitable result, due to the helical paths followed by the ribbons, is that the twisted string tensile strength is less than the sum of intrinsic tensile strengths of all ribbons comprising the twisted string, i.e.; less than the untwisted string tensile strength. This effect is documented, for example, by Backer in "Structural Mechanics of Fibers, Yarns and Fabrics," J. W. S. Hearle et al., editors, Wiley-Interscience, New York (1969), volume 1, at 9–11, and by Hearle, ibid., at 175–253.

Bridge, Jr., U.S. Pat. No. 3,419,059, in FIG. 3, presents a relationship between twisted yarn modulus and zero twist yarn modulus as a function of twist. As shown therein, the yarn modulus is at best—(i.e.; in the untwisted state)—equal to the constituent filament modulus. Each of the Backer, Hearle and Bridge, Jr. references teaches that increasing the level of twist of a continuous filament singles twisted structure lowers the ultimate singles twisted structure strength and modulus.

The conditions under which gut string breaking strength is measured, including type of testing machine, type of grips or jaws in the machine, gauge length, jaw speed and ambient relative humidity, will affect the results obtained. For example, a conventional gut string made of 16 ribbons of beef gut, each about $\frac{5}{8}$" in width, twisted an average of 2.36 turns/inch in one direction had an average tensil strength of 125.33 lb. determined using an Instron Testing Machine and of 115.0 lb. using a Scott Tensile Tester. Corresponding average tensile breaking stress (psi) values were 63,830 and 58,569 respectively.

Analysis of the strength of a conventional twisted gut string permits determination of the intrinsic strength of each $\frac{5}{8}$ inch gut ribbon. A 16 ribbon string made from beef gut and having an outer diameter of 0.050 inch and an outer surface helix angle ($\alpha_s$) of 20.4°, as shown schematically in FIG. 3, can be considered to have a geometric arrangement in which one ribbon is located in the center core (11) of the string and six ribbons surround the central ribbon (11) and form an intermediate layer (12). The nine remaining ribbons form the outermost layer (13). When one pitch of the helically-twisted string is opened as shown schematically in FIG. 4, and rolled out to form a set of triangles, each triangle has a hypotenuse proportional in length to the length of the ribbons in each of the layers.

The angle corresponding to each of the hypotenuses can be calculated by application of geometric principles. For the core ribbon, the helix angle ($\theta_{11}$) is zero. For the intermediate layer ribbons, the helix angle ($\theta_{12}$) is 8.461° and for the outermost layer ribbons, the helix angle ($\theta_{13}$) is 16.569°.

As shown in FIG. 5, for any helically-wound string having a diameter of $D_s$, (in inches) and a helical pitch $H_s$ (in inches), wherein T represents a line tangent to the surface helix, $$H_s \text{ (in inches)} = 1/(\text{string twist in turns/inch}) = 1/T_s$$

Therefore, $$\tan \alpha_{s'} = \pi D_{s'}/H_s = \pi D_{s'} T_s$$

According to the teachings of Hearle, ibid., at page 177, equation 4.5, when a singles twisted string, as described above, treated as a twisted continuous filament yarn, is strained by an amount $\epsilon_s$, each of the individual component gut ribbons will be strained by an amount $\epsilon_r = \epsilon_s \cos^2\theta$, where $\theta$ is the angle of helix followed by the gut ribbon.

In the case of a straight line load-strain relationship, the load ($f_r$) acting on a ribbon in the direction of a tangent to the helix followed by the ribbon as a result of twisted string strain $\epsilon_s$ is $$f_r = (F_r)_{max} \times \epsilon_s \cos^2\theta / (\epsilon_r)_{max}$$

where $(\epsilon_r)_{max}$ is the ribbon maximum (breaking) strain in inches/inch and $(F_r)_{max}$ is the ribbon maximum (breaking) strength in lb. The latter is also known as the intrinsic strength.

The string axial load will be the sum of all axial components of load acting on all constituent ribbons. It follows that the string breaking load $F_s$ is related to the ribbon intrinsic tensile strength by the following equation:

$$F_s = (F_r)_{max} + 6\left[\frac{(\epsilon_s \cos^2\theta_{12})(\cos\theta_{12})}{(\epsilon_r)_{max}}\right] \times (F_r)_{max} + 9[(\epsilon_s \cos^2\theta_{13})(\cos\theta_{13})/(\epsilon_r)_{max}] \times (F_r)_{max}$$

At the breaking point, $\epsilon_s = (\epsilon_r)_{max}$. Therefore, $$\begin{aligned} F_s &= (F_r)_{max} + 6\cos^3\theta_{12}(F_r)_{max} + 9\cos^3\theta_{13}(F_r)_{max} \\ &= (F_r)_{max}[1 + 6\cos^3(8.461°) + 9\cos^3(16.569°)] \\ &= (F_r)_{max}[14.731]. \end{aligned}$$

In the case of the string, for which the average breaking strength $F_s$ was 115 lb. (Scott Tensile Tester), the intrinsic tensile strength per $\frac{5}{8}$ inch wide ribbon $(F_r)_{max}$ is, in accordance with the above analysis, equal to 115/14.731=7.807 lb., that is, 7.807/($\frac{5}{8}$)=12.5 lb. per inch of ribbon width.

It will therefore be apparent that the maximum theoretical strength for a 16-ribbon string is equal to $16 \times 7.807 = 124.912$ lb. and for a 14-ribbon string is equal to $14 \times 7.807 = 109.298$ lb. Maximum strength will be realized only in the absence of string twist, that is, when all ribbons are parallel-laid and oriented in the direction of loading.

Actual values for conventional helically-wound 16- and 14-ribbon singles twisted gut strings are 115 and 100 lb., respectively (Scott Tensile Tester). Therefore, in such conventional gut strings, the utilization efficiency of gut ribbon strength are:

| | |
|---|---|
| 16-ribbon | $(115/124.912) \times 100 = 92.06\%$ |
| 14-ribbon | $(100/109.298) \times 100 = 91.49\%$ |

The analysis presented above also permits calculation of intrinsic gut ribbon breaking stress. Based upon an intrinsic strength of 7.807 lb. and ribbon cross-sectional area, $(0.050)^2\pi/(4 \times 16) = 0.00012272$ square inches, the intrinsic gut ribbon breaking stress is $7.807/0.00012272 = 63{,}617$ psi.

A gut string made in accordance with this invention is shown in FIG. 6, wherein two twisted/retwisted strands are employed. The strands, each of a plurality of parallel-laid gut ribbons twisted in a first direction, are shown in FIG. 6A, in which $1/n_s$ is the reciprocal of the number of turns per inch in the first direction. In FIG. 6B is shown a gut string, obtained by opposite direction retwisting two gut strands, wherein $1/N_p$ is the reciprocal of the number of turns per inch for the combined retwisted strands. FIG. 6C is a cross-sectional view through line AA' of FIG. 6B. Various combinations within the preferred range of $n_s$ (0.25–8 turns per inch) and $N_p$ (0.25–4 turns per inch) were utilized with the objective of obtaining a final twisted string such that the outermost ribbons in the twisted component strands have—in the twisted string—a final direction of orientation parallel to that of the twisted string axis. In such twisted strings, the string strength should be equal to or less than the sum of intrinsic tensile strength of all component ribbons, i.e. maximum string strength $\leqq (N_r) \times$ (average intrinsic tensile strength per gut ribbon), where $N_r$ is the number of gut ribbons in the final string. In this particular case, the intrinsic tensile strength per $\frac{5}{8}$ inch wide gut ribbon = 7.807 lb., thus; the maximum expected final string strength $= (N_r) \times (7.807)$ lb.

The tensile strength data for 14, 15 and 16 ribbon strings made in accordance with this invention are shown in the table below;

| TOTAL NUMBER OF $\frac{5}{8}$ INCH GUT RIBBONS ($N_r$) | NUMBER OF GUT RIBBONS IN EACH STRAND | MAXIMUM EXPECTED STRING STRENGTH ($N_r$) × (7.807) (lbs.) | ACTUAL STRING STRENGTH (lbs.) |
|---|---|---|---|
| 14 | 7 & 7 | 109.3 | 121 |
| 15 | 7 & 8 | 117.1 | 128 |
| 16 | 8 & 8 | 124.9 | 135 |

As shown therein, the actual string strength—(Scott Tensile Tester)—consistently exceeds the maximum expected string strength, predicted from the conventional helically-wound structure made from the same type of gut ribbons. These data show an unexpected improvement in the intrinsic gut strength.

The effectiveness of utilization of such improved intrinsic gut strength depends on the final angle of orientation, ($\phi$), shown in FIG. 7, of the component ribbons with respect to the twisted string axis. Of course, best utilization efficiency is realized when such angle of orientation ($\phi$) is zero. However, as shown in the table below, approximately 99% of the improved intrinsic gut strength would be realized for $\phi \leqq 5°$ and at least 90% of the improved intrinsic gut strength would be realized for $\phi \leqq 15°$. Accordingly, string constructions will be preferred wherein $\phi$ is less than 15°. More preferably, $\phi$ is less than 5°, most preferably about zero.

| ANGLE $\phi$ (DEGREES) | COS $\phi$ | COS$^3$ $\phi$ | EFFICIENCY OF USE OF GUT RIBBON INTRINSIC STRENGTH |
|---|---|---|---|
| 0° | 1.0 | 1.0 | 100% |
| 5° | 0.9962 | 0.989 | 98.9% |
| 10° | 0.9848 | 0.955 | 95.5% |
| 15° | 0.9659 | 0.9012 | 90.1% |
| 20° | 0.9397 | 0.8297 | 83% |
| 30° | 0.8660 | 0.6495 | 65% |

Gut strings of this invention have been judged to have "playing qualities" better than those of presently available gut strings. They have also been judged in actual play testing to hold their tension longer—(i.e. exhibit a lower rate of stress relaxation)—while preserving all other natural gut playing characteristics such as resiliency and recovery. Their twisted ribbon-like form was also judged to offer a generally rougher surface to the ball and hence enhance ball control, especially for spin. In addition, the strings are thinner than prior art strings and provide acceptable playing quality at lower material costs than heretofore possible.

It is postulated that gut strings made by the teachings of this invention owe their improved properties to enhanced molecular or fibrillar orientation, resulting from the twisting, retwisting and drying under tension.

The gut strings of this invention can be employed in structures containing filamentary reinforcement elements. In FIG. **8-*a* is shown a structure in which gut strands 21 and 22 of twisted parallel-laid gut ribbons are retwisted around a reinforcement core element 23. FIG. 8-*b* shows a cross-sectional view through line B—B' of FIG. 8-*a*. The strings may also be covered, completely or partially, with filamentary reinforcement elements. FIG. 11 shows a structure in which the gut strands 31 and 32 are covered with helically wound filamentary reinforcement elements 33 and 34. FIG. 9 shows a gut string of this invention 51 covered with braided reinforcement filamentary elements 52. If desired, as shown in FIG. 10, at least one of the braided reinforcement elements 41** can be relatively thicker than the other elements so as to provide an integrated slip-resistant helical ridge on the outer surface of string. Such slip-resistant helical ridge would not only enhance ball control, but also provide an interlocking network of helical projections at the strings cross-over points, thus minimizing string shifting in the racket.

The filamentary reinforcement elements may be of any polymeric or metallic material. Aramid polymer is used in the form of filaments, which are used as reinforcement core elements or wound helically or braided around the gut core. Aramid filaments are available under the name of KEVLAR (du Pont trademark). Aramid resins are also known generically as aromatic polycarbonamides, as described in U.S. Pat. Nos. 3,652,510; 3,673,143 and 3,699,085. Fibers made from this family of polymers have extremely high strength, high modulus, good wear properties and low elongation, as disclosed by Simpson (U.S. Pat. No. 4,202,164).

The aramid filaments can be wound helically around the gut core or braided therearound. It is preferred that the aramid filaments be braided over the gut core, using conventional braiding procedures employing a plurality of bobbins. The breaking strength of the racket strings is affected by the angle at which the bobbins are disposed with respect to the gut core. To achieve maximum breaking strength in the braided core structure, it is preferred to maintain the braiding bobbins at an angle of 40°–50° with respect to the core during braiding. Most preferably, the bobbins will be at an angle of 43°–47°.

The water-resistant, vapor-impermeable, flexible, smooth, adhesive polymeric resin, with which the wound or braided gut core substructure is impregnated may be selected from varnishes or sealers, whether based on natural resins, alkyd resins or polyurethanes. It is preferred to employ an air-curing polyurethane varnish, applied by passing the string through a solution of the varnish in an organic solvent.

Air-curing polyurethane systems are based on reaction products from diisocyanates, polyols and drying oils. The resins cure by reaction of the drying oil with oxygen in the air. Materials adapted for use in the practice of this invention are also known as urethane oils and are prepared by making a partial ester by reaction between a free fatty acid and a polyol or by alcoholysis of an oil with a polyol. The resulting intermediate partial ester is reacted with toluene diisocyanate or another selected diisocyanate to give an oil-modified polyurethane.

Another polyurethane system which can be used is the type of top coating disclosed by Harding (U.S. Pat. No. 3,298,856). Polyurethane varnishes are preferred to alkyd varnishes because of their shorter drying time.

The polymeric resin is preferably applied from a solution in an organic solvent, of which methyl ethyl ketone, ethyl acetate, acetone, chlorobenzene and aromatic alcohols are exemplary. A preferred system for impregnating the gut-aramid filament substructure or filamentary reinforcement is a solution of an air-drying polyurethane varnish, containing 20–25% of solids, in a mixed aromatic alcohol solvent.

The polyurethane varnish is conveniently applied by running the string through the solution of varnish under ambient conditions. Because the polymeric resin is dissolved in the solvent, the solution will migrate through the braid or helical winding or aramid filaments to the gut core and provide the requisite adhesion between the layers. It has been found that the adhesive coating cures to a dry, non-tacky touch within about two hours at room temperature.

It is preferred, according to the practice of this invention, to employ a plurality of layers of adhesive polymeric coating, most preferably two or three coats. The second and subsequent coats or adhesive polymeric coating are applied in the same fashion as the first, allowing 1–4 hours of drying at ambient temperature between successive coats.

Use of a plurality of coats of polymeric resin permits encapsulation of the aramid filaments braided or wound around the gut core, so as to exclude moisture from the aramid and substantially decrease the likelihood of moisture-induced degradation of the aramid winding or braid and provides abrasion resistance.

Strings for sports rackets, made as above, have a breaking strength (tensile strength) of at least 100 lb., generally as high as 140 lb. or higher. Therefore, these strings are particularly adapted for stringing oversize rackets at up to 85 lb. of tension during stringing. The strings of this invention can also be strung at conventional tensions in standard rackets, to provide longer-lived strings than gut-based strings presently available. String thus employed has an acceptable life cycle and has the resiliency or "feel" of natural gut.

Because aramid fibers are damaged by exposure to ultra-violet light, it may be desirable to prolong the life of the strings by incorporating into one or more of the polymeric resin coatings an ultraviolet absorber. For a dramatic effect, the ultraviolet absorber can be carbon black; the resulting strings will be black or gray. If a lighter-colored string will be more acceptable to the ultimate user than a black string, a relatively colorless organic ultraviolet absorber, compatible with the polymeric resin and solvent system, can be used. Typical of organic ultraviolet absorbers which can be used are coumarin ethers, esters of p-aminobenzoic acid or substituted p-aminobenzoic acids, such as glyceryl p-aminobenzoate; esters of p-methoxycinnamic acid, such as 2-ethoxyethyl p-methoxycinnamate; benzophenone derivatives, such as 2-hydroxy-4-methoxybenzophenone and derivatives of bis-alpha-cyano-beta, beta-diphenylacrylic acid.

Because the strings made by the teachings of this invention are flexible, delamination or abrasion may become a problem during stringing of sports rackets, particularly at the eight so-called double holes of a tennis racket. To facilitate the stringing procedure, the ends of the string can be cut at an angle of 15°–20° and the cut end coated with a stiffening resin, such as an acrylic or epoxy resin. The resulting end structure can be strung more readily than the flexible unmodified string.

DESCRIPTION OF MOST PREFERRED EMBODIMENT

Preferably, gut strings made in accordance with this invention will be those comprising two gut strands, each of 6–8 gut ribbons, impregnated with at least one coating of water-resistant, vapor-impermeable, wear-resistant, flexible, smooth adhesive polymeric resin, wherein the angle of orientation ($\phi$) of the gut ribbons with respect to the longitudinal axis of the gut string is less than 5°.

A preferred process in accordance with the invention will be that wherein the gut string comprises two strands, each of 6–8 gut ribbons; wherein the wet parallel-laid gut ribbons in the strands are twisted during step (a) in the first direction at 1.5–4.0 turns per inch and the wet strands assembled in step (b) are retwisted in the opposite direction at 0.5–2.0 turns per inch. Most preferably, the strings will be dried under a tension of 15–30 pounds.

BRIEF DESCRIPTION OF THE DRAWINGS

In FIG. 1 is shown an enlarged cross-sectional view of the tennis string of commonly-assigned U.S. Pat. No. 4,391,088.

In FIG. 2 is shown an enlarged side view of a tennis string of commonly-assigned application, Ser. No. 339,082.

In FIGS. 3–5 are shown an analysis of the geometry of a conventional twisted gut string, made from a plurality of parallel-laid gut ribbons.

Figure 6A:
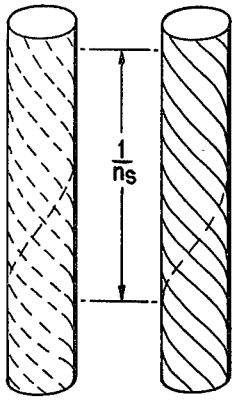
FIG. 6*a* shows two twisted strands of gut prior to twisting together to form a gut string in accordance with the instant invention.
Figure 7:
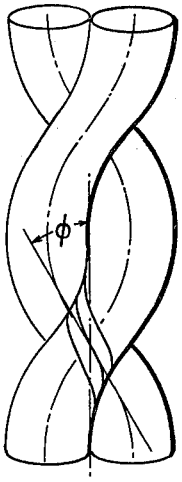
In FIG. 7 is shown a gut string of the invention, with a representation of the angle of orientation ($\phi$).
Figure 8A:
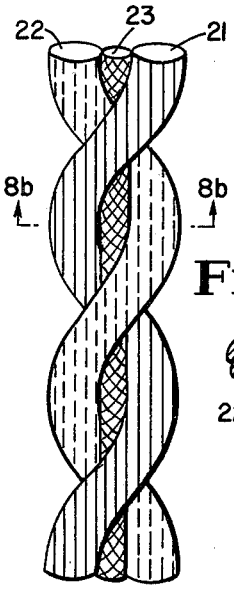
FIGS. 8*a*, 9 and 11 depict strings of this invention, reinforced in various ways.
Figure 8B:
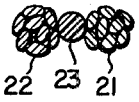
FIG. 8*b* shows a cross section of FIG. 8*a*.
Figure 6B:
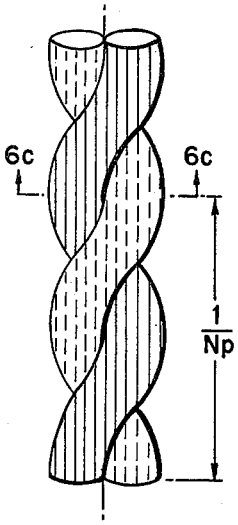
FIG. 6*b* depicts a gut string in accordance with the instant invention.
Figure 9:
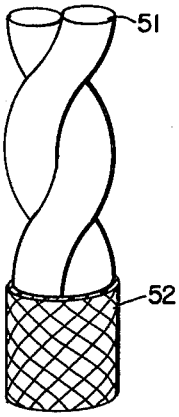
Figure 10:
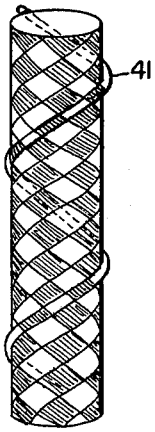
FIG. 10 depicts a slip-resistant braided reinforcement which may be employed with the string of the instant invention.
Figure 11:
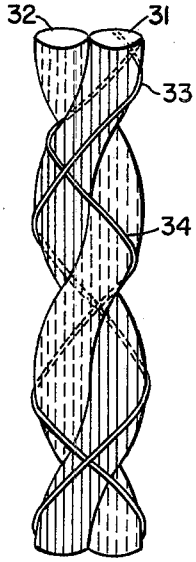
Figure 6C:
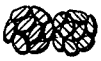
FIG. 6*c* shows a cross section of FIG. 6*b*.

Without further elaboration, it is believed that one skilled in the art can, using the preceeding description, utilize the present invention to its fullest extent. The following preferred specific embodiments are, therefore, to be construed as merely illustrative and not limitative of the remainder of the disclosure in any way whatsoever. In the following Examples, temperatures are set forth uncorrected in degrees Celsius. Unless otherwise indicated, all parts and percentages are by weight.

EXAMPLE 1

A twisted conventional gut string was made by twisting together 16 ribbons of beef gut, each about $\frac{5}{8}$ inch wide, to an average of 2.36 turns per inch (550 turns in 19 feet, 1000 turns in 36 feet), drying and polyurethane coating the product. The gut string had a diameter of 0.050 inch and a surface helix angle ($\alpha_s$) of 20.4°.

(a) Samples tested in an Instron Testing Machine (12 inch gauge length) having flat grips padded with sand paper and a jaw speed of 10 inches/minute under 38–76% relative humidity had an average tensile strength of 125.33 lb. and an average tensile breaking stress of 63,830 psi.

(b) Samples tested in a Scott Tensile Tester with a 22-inch gauge length, capstan type grips and a jaw speed of 6.5 inches/minute, operated at 40–80% relative humidity, had an average tensile strength of 115.0 lb. and an average tensile breaking stress of 58,569 psi.

EXAMPLE 2

Twisted gut strings were made by:

(a) Twisting wet strands of seven parallel-laid wet gut ribbons together at 3.07 turns per inch and retwisting two wet strands in the opposite direction at 1.32 turns per inch and drying the resulting string;

(b) Twisting wet strands of seven parallel-laid gut ribbons together at 3.07 turns per inch and retwisting two wet strands together in the opposite direction at 1.1 turns/inch and drying the wet string and (c) Twisting wet strands of eight parallel-laid gut ribbons together in a first direction at 2.63 turns/inch and retwisting the two strands in the opposite direction at 1.1 turns per inch and drying the wet string.

The strands of parallel-laid gut ribbons were kept taut during twisting and retwisting and dried under a tension of 15–30 lb. at ambient temperature. The dried strings were coated with polyurethane.

EXAMPLE 3

Gut strings made in Example 2 were tested in the Scott Tensile Tester, under conditions as in Example 1 (b), with the following results:

Tensile Strength of String (a): 125.3 lb.
Tensile Strength of String (b): 124.3 lb.
Tensile Strength of String (c): 135 lb.

EXAMPLE 4

Polished beef gut (1 in FIG. 2) is covered by braiding with aramid filaments (2 in FIGS. 1 and 2). Covered gut is passed through a solution of air-drying polyurethane varnish (21% solids in an aromatic alcohol mixture) without stretching the gut. The resulting coated gut is allowed to dry in air for 2–3 hours before application of a second coat of the same polyurethane resin. After 2–3 hours' drying, a third coating of the same polyurethane resin is applied and allowed to dry. The final polyurethane resin coating is a unitary coating (3 in FIGS. 1 and 2), extending from the surface of the gut through and over the braided aramid coating.

EXAMPLE 5

Unpolished beef gut (0.040–0.050 inch in diameter) was covered by braiding with aramid (KEVLAR) filaments, using six ends of aramid filaments each of 400 denier. The bobbins holding the aramid fibers were kept at an angle of 44°–46° with respect to the gut during braiding.

The braid-covered gut was passed through a solution of air-drying polyurethane varnish (22% solids) in an aromatic alcohol mixture. The polyurethane varnish was applied under ambient conditions, without application of stretching forces to the braid-covered gut. The polyurethane coating was allowed to dry and cure under ambient conditions for two hours. Second and third coats of polyurethane were applied in the same way.

The string obtained had a tensile strength of 100–140 lb. and could be used for stringing oversized tennis rackets, which had the same playing characteristics as rackets strung with gut, not strengthened with aramid filaments.

EXAMPLE 6

Unpolished sheep gut is covered with aramid filaments, which are wound helically over the gut core. The wound core is coated with two coats of air-drying polyurethane varnish, which is applied in a vacuum chamber from a 20–25% solution in aromatic alcohols. Each coating is allowed to dry in air for 1.5–2.5 hours.

The preceeding examples can be repeated with similar success by substituting the generically or specifically described reactants and/or operating conditions of this invention for those used in the preceeding examples.

From the foregoing description, one skilled in the art can easily ascertain the essential characteristics of this invention and, without departing from the spirit and scope thereof, can make various changes and modifications of the invention to adapt it to various usages and conditions.

I claim:

1. A gut string for sports rackets, comprising at least two gut strands, each strand comprising a plurality of gut ribbons twisted together in a first direction, which strands are combined and retwisted in a direction opposite to the first direction.

2. The gut string of claim 1, wherein the gut ribbons comprising the gut strands are twisted together in the first direction at 0.25–8.0 turns per inch and the gut strands comprising the gut string are retwisted together at 0.25–4.0 turns per inch in the direction opposite to the first direction.

3. The gut string of claim 1, wherein the gut ribbons comprising the gut strands are twisted together in the first direction at 1.5–4 turns per inch and the gut strands comprising the gut string are retwisted together at 0.5–2.0 turns per inch in the direction opposite to the first direction.

4. The gut string of claim 1, wherein the angle of orientation ($\phi$) of the outermost layer gut ribbons with respect to the longitudinal axis of the gut string is less than 15°.

5. The gut string of claim 1, wherein the angle of orientation $\phi$ of the outermost layer gut ribbons with respect to the longitudinal axis of the gut string is less than 5°.

6. The gut string of claim 1, wherein the angle of orientation $\phi$ of the outermost layer gut ribbons with respect to the longitudinal axis of the gut string is approximately 0°.

7. The gut string of claim 1, wherein each gut strand contains 6–8 gut ribbons.

8. The gut string of claim 1, which comprises two gut strands.

9. The gut string of claim 1, which comprises 2 gut strands each of 6–8 gut ribbons.

10. The gut string of claim 9, wherein the gut ribbons comprising the gut strands are twisted together in the first direction at 1.5–4 turns per inch and the gut strands comprising the gut string are retwisted together at 0.5–2.0 turns per inch in the direction opposite to the first direction.

11. The gut string of claim 9, wherein the angle of orientation ($\phi$) of the outermost layer gut ribbons with respect to the longitudinal axis of the gut string is less than 15°.

12. The gut string of claim 9, wherein the angle of orientation ($\phi$) of the outermost layer gut ribbons with respect to the longitudinal axis of the gut string is less than 5°.

13. The gut string of claim 9, wherein the angle of orientation ($\phi$) of the outermost layer gut ribbons with respect to the longitudinal axis of the gut string is approximately 0°.

14. The gut string of claim 1, covered with filamentary aramid reinforcement and impregnated with at least one coating of water-resistant, vapor-impermeable, wear resistant, flexible, smooth adhesive polymeric resin.

15. The gut string of claim 14, wherein the filamentary aramid reinforcement is helically wound around the gut string.

16. The gut string of claim 14, wherein the filamentary aramid reinforcement is braided over the gut string.

17. The gut string of claim 16 wherein, at least one element of the filamentary reinforcement braided over the gut string is relatively thicker than the other elements so as to provide an integrated slip resistant helical ridge on the outer surface of string.

18. The gut string of claim 1, reinforced with filamentary strand elements located along the longitudinal axis of the gut string.

19. The gut string of claim 1, impregnated with at least one coating of water-resistant adhesive polymeric resin.

20. The gut string of claim 19, wherein the adhesive resin is an air-curing polyurethane resin and two or three coatings of said resin are used.

21. The gut string of claim 1, wherein the gut ribbons in the string have an average tensile strength above 12.5 lb. per inch of ribbon width.

22. The gut string of claim 1, which comprises 2 gut strands, each of 6–8 gut ribbons, covered with filamentary aramid reinforcement and impregnated with at least one coating of water-resistant, vapor-impermeable, wear-resistant, flexible, smooth adhesive polymeric resin.

23. The gut string of claim 22, wherein the angle of orientation ($\phi$) of the outermost layer gut ribbons with respect to the longitudinal axis of the gut string is less than 15°.

24. The gut string of claim 22, wherein the angle of orientation ($\phi$) of the outermost layer gut ribbons with respect to the longitudinal axis of the gut string is less than 5°.

25. The gut string of claim 22, wherein the angle of orientation ($\phi$) of the outermost layer gut ribbons with respect to the longitudinal axis of the gut string is approximately 0°.

26. The gut string of claim 25, wherein the gut ribbons in the string have an average tensile strength above 12.5 lb. per inch of ribbon width.

27. A process for making a gut string for sports rackets, comprising the steps of:

(a) assembling strands of a plurality of wet parallel-laid natural gut ribbons and individually twisting the thus-assembled wet strands in a first direction, (b) assembling at least two strands assembled and twisted in step (a) and retwisting the thus-assembled wet strands in a direction opposite to the first direction to form a wet gut string and (c) drying the wet gut string of (b) under a tension of at least 5 lb.

28. The process of claim 27, wherein each strand comprises approximately the same number of wet natural gut ribbons and the gut ribbons are of approximately equal length, wherein the wet strands are twisted during step (a) in the first direction at 0.25–8.0 turns per inch and the wet strands assembled in step (b) are retwisted in the opposite direction at 0.25–4.0 turns per inch.

29. The process of claim 27, wherein each strand comprises approximately the same number of wet natural gut ribbons and the gut ribbons are of approximately equal length, wherein the wet strands are twisted during step (a) in the first direction at 1.5–4 turns per inch and the wet strands assembled in step (b) are retwisted in the opposite direction at 0.5–2 turns per inch.

30. The process of claim 27, wherein the wet strands of natural gut ribbons are twisted and retwisted under a tension of at least 5 lb.

31. The process of claim 27, wherein the wet gut string produced in step (b) is dried under a tension of 15–30 lb.

32. The process of claim 27, wherein the gut string comprises two strands, each of 6–8 natural gut ribbons.

33. The process of claim 27, wherein the gut string comprises two strands, each of 6–8 gut ribbons; wherein the wet strands are twisted during step (a) in the first direction at 1.5–4 turns per inch and the wet strands assembled in step (b) are retwisted in the opposite direction at 0.5–2 turns per inch.

34. The process of claim 27, wherein the gut string comprises two strands, each of 6–8 gut ribbons and the gut ribbons are of approximately equal length; wherein the wet strands are twisted during step (a) in the first direction at 1.5–4 turns per inch and the wet strands assembled in step (b) are retwisted in the opposite direction at 0.5–2 turns per inch; wherein the wet strands are twisted and retwisted under a tension of least five lb. and the wet gut string produced in step (b) is dried under a tension of 15–30 lb.

35. The process of claim 27, wherein the dried gut string produced in step (c) is coated or impregnated with at least one coating of water-resistant, vapor impermeable, wear resistant, flexible, smooth adhesive polymeric resin.

36. The process of claim 35, wherein the polymeric resin is an air-curing polyurethane resin.

37. The process of claim 27, wherein the dried gut string produced in step (c) is coated or impregnated with at least one coating of water-resistant, vapor impermeable, wear resistant, flexible, smooth adhesive polymeric resin and wherein the gut string is covered at least partially with filamentary aramid reinforcement.

38. The process of claim 37, wherein the filamentary aramid reinforcement is helically wound around the gut string.

39. The process of claim 37, wherein the filamentary aramid reinforcement is braided over the gut string.

40. The process of claim 27, wherein the dried gut string produced in step (c) is coated or impregnated with at least one coating of water-resistant, vapor impermeable, wear resistant, flexible, smooth adhesive polymeric resin, and wherein the gut string is reinforced with filamentary strand elements located along the longitudinal axis of the gut string.

41. A gut string made by the process of claim 27.

42. A gut string made by the process of claim 37.

43. A gut string made by the process of claim 40.

44. A sports racket strung with the gut string of claim 1.

45. A sports racket strung with the gut string of claim 3.

46. A sports racket strung with the gut string of claim 4.

47. A sports racket strung with the gut string of claim 9.

48. A sports racket strung with the gut string of claim 10.

49. A sports racket strung with the gut string of claim 11.

50. A sports racket strung with the gut string of claim 14.

51. A sports racket strung with the gut string of claim 17.

52. A sports racket strung with the gut string of claim 18.

53. A sports racket strung with the gut string of claim 19.

* * * * *